United States Patent [19]

Filosa

[11] 4,132,257

[45] Jan. 2, 1979

[54] PROTECTIVE DEVICE FOR LOGS AND LOG RACKS

[76] Inventor: Michael Filosa, Granite Brook Dr., Granite Springs, N.Y. 10527

[21] Appl. No.: 816,438

[22] Filed: Jul. 18, 1977

[51] Int. Cl.[2] ..... B65D 65/02

[52] U.S. Cl. ..... 150/52 R

[58] Field of Search ..... 150/52 R, 526, 1.5; 190/51; 206/335; 126/283

[56] References Cited

U.S. PATENT DOCUMENTS

| | | | |
|---|---|---|---|
| 2,635,562 | 4/1953 | Abramson | 150/52 R |
| 2,659,481 | 11/1953 | Jones | 150/52 R |
| 2,683,507 | 7/1954 | Coven | 150/52 R |
| 2,731,972 | 1/1956 | Braun | 150/52 R |
| 3,087,585 | 4/1963 | Knuth | 150/52 R |
| 3,470,928 | 10/1969 | Schwartz | 150/52 R |
| 3,783,766 | 1/1974 | Boucher | 150/52 R |

*Primary Examiner*—R. E. Hart

[57] ABSTRACT

A protective device for stacked logs and log racks is disclosed; the device generally including a flexible sleeve open at one end and along one longitudinal side and having a closable opposite end; the device adapted to be secured directly to the log rack if desired.

7 Claims, 5 Drawing Figures

PROTECTIVE DEVICE FOR LOGS AND LOG RACKS

BACKGROUND OF THE INVENTION

This invention relates to a device for protecting logs when the same are stored or stacked on a log rack or the like, which rack is generally kept outdoors. The device thereby effectively segregrating the logs and log rack from the elements and providing for dry logs when needed, an increase in the life of the log rack, and a means whereby the eyesore of the "log collection"is reduced.

It is presumed that people who enjoy the comforts of a wood-burning fireplace or stove have always endeavored to maintain a supply of dry wood, such that they could always operate their stoves or fireplaces irrespective of the climatic conditions. Many methods have probably been practiced to achieve this result, for example, storing the wood under a sheltered area, covering the wood with some temporary yet waterproof sheeting (i.e., a sheet of plastic, etc.) and like methods. The foregoing, however, are, at best, only temporary, clearly inadequate for any continued use and cumbersome in operation.

The known prior art is limited to three patents, U.S. Pat. Nos. 3,521,689; 3,521,690; and 3,886,988; none of which are even suitable devices for covering and protecting logs placed under a log holder. In point of fact, all three teachings are directed to bags or carrying cases for athletic articles. One very notable distinction between the instant invention and those teachings, aside from the fact that they are carrying containers, is that they cannot removably cover one item resting upon another but rather they envelope the entire structure.

SUMMARY OF THE INVENTION

It is accordingly an object of the instant invention to provide for a new and improved protective device for the covering of stacked logs and log racks.

It is another object to provide for one that is easily employed and convenient to use with most suitable conventional log racks.

It is a further object to provide for the same at relatively little cost thereby making it generally available.

These and other objects and advantages of the invention will become more apparent from a consideration of the following detailed disclosure and claims and by reference to the accompanying drawings in which:

Figures 1, 2, 3, 4, 5:
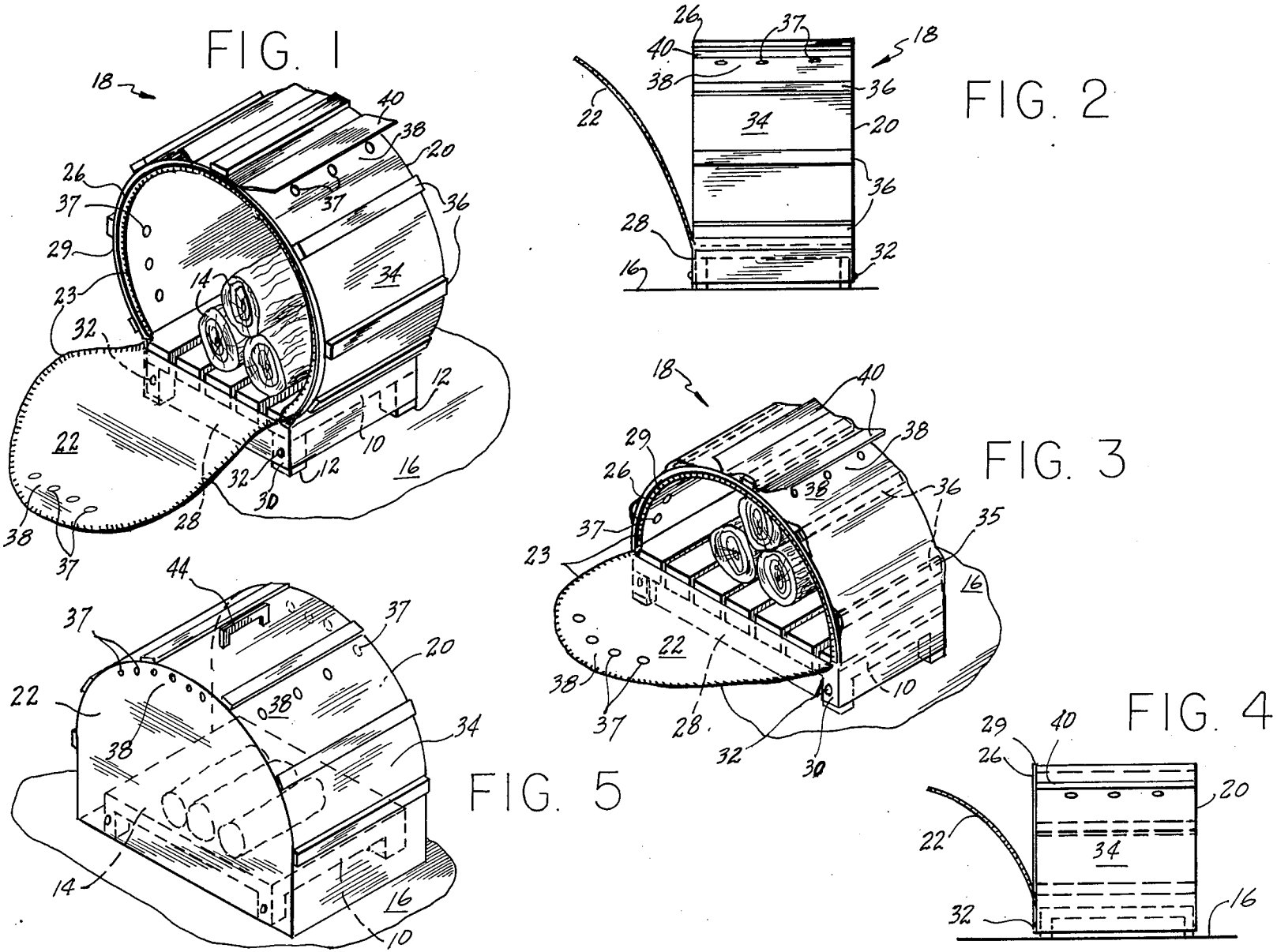
FIG. 1 is a pictorial view of one embodiment of the device disposed stop a log rack.
FIG. 2 is a side elevational view thereof.
FIG. 3 is a pictorial view of a second embodiment.
FIG. 4 is a side elevational view thereof.
FIG. 5 is a pictorial view of a third embodiment.

Broadly speaking, the instant invention includes the provision of a flexible, (self-supporting), shape-retaining protective device for use in conjunction with stored logs, comprising a hollow walled partial sleeve capped at one distal end and open at the opposite distal end, movable capping means disposed at the opposite end, means for opening and closing the movable capping means, the capping means movable between an open and closed position about the open end, an apron depending from a lower portion of the capping means, a slit running substantially entirely along the longitudinal axis of the sleeve between the two ends, a plurality of rigid ribs disposed in space apart relation substantially about the entire longitudinal axis of the sleeve.

DETAILED DESCRIPTION

Referring more particularly to the drawings, there is shown a conventional log rack or holder 10 that is generally a structure supported above the ground by legs 12. The holder 10 is generally constructed of a metallic material though it need not be, and may be a slatted structure providing for air flow between the logs 14 supported therein. In practice, the holder 10 rests atop the ground 16 thereby maintaining the logs 14 thereabove.

In a preferred embodiment of the invention, as is shown in FIGS. 1-2, there is provided a flexible sleeve-like structure 18 that is generally wider than it is long and liquid impermeable, though air permeable. The sleeve 18 will have two ends transverse the longitudinal axis, one end 20 will generally be fixedly closed, while the opposite end 22 will be adjustably closable. The means 23 for effecting the closure of the open end 22, may take any suitable form, i.e., a zipper, snaps, buttons, "VELCRO," etc. with part of the means being affixed about the periphery or circumference of the outer edge of the end 22, and a cooperating portion thereof affixed to a flange or lip 26 disposed about the outer edge of the exposed open end of the sleeve 18. The sleeve 18 is of sufficient length to accommodate the holder 10 therein, i.e., about 2–6 feet wide and about 1–3 feet long. The sleeve 18 will display an opening substantially completely along its longitudinal axis thereof, having parallel co-extensive sides forming the same from one end 20 to the other 22, such as along its underbelly such that the holer 10 can be disposed therebetween beneath the umbrella formed by the sleeve 18 and contact the ground 16 when covered by the sleeve 18. The longitudinal opening will be about one-fourth of the circumference of the sleeve 18, and be an elongated U-shape when viewed longitudinally, thereby providing for a fit of the sleeve 18 around the holder 10 while at the same time allowing for an air opening along the length of the sleeve 18 contiguous with that of the holder 10. It should be noted that the end 20 is complete and seals off that end of the sleeve 18, in effect providing for a capped end at that terminal portion of the sleeve 18. The opposite end 22, on the other hand, is adapted to open and close about a mouth opening at that end of the sleeve 18. The base of the end 22 will include a flap or apron 28 that is adapted to drape over the exposed portion of the holder 10 when the end 22 is in the closed position. This is accomplished by having the flap 28 extend below the lowest portion of the end 22 and the sleeve 18. The apron 28 is affixed to or integral with the base of the sleeve 18 and end 22 thereby overlaying against the holder 10 between the open sides of the longitudinal opening at the base of the end 22.

In this manner, the end 22 effectively covers the logs 14 while at the same time providing a means whereby the end 22 can pivot between an open and closed position. The end 22 thus pivots or moves between a closed position against the sleeve 18 whereby the means 23 may be employed to seal it thus making it integral with the remainder of the sleeve 18 and an open position away therefrom about the apron 28. A circular rigid member 29 may be disposed about the circumference of the end 22 as well as end 20, such as in a pocket therefor or merely affixed thereto to provide for additional self supporting features. A pair of lateral wings 30 depend from the apron 28 at opposite lateral sides thereof below the end 22 and forward of the longitudinal opening and are adapted to be affixed to the legs 12 by suitable means 32 such as snaps, hook and eye, etc., thereby securing the same about the legs 12 and maintaining the sleeve 18 in place.

The actual body of the sleeve 18 may be constructed of any suitable flexible material 34, i.e., plastic sheeting (polyethylene), fabric, etc., and preferably will contain a plurality of rigid ribs 36 (i.e., metal, wood, etc.) running for at least a portion, preferably throughout the long axis thereof. The ribs 36 may be adhesively secured to the body of the sleeve, disposed in pockets 35 formed therein to receive the same or attached thereto by any other suitable means.

In the embodiment of the invention, the cross sectional view of the sleeve represents an incomplete circle, though it is generally greater than a half circle, i.e., three-fourths circle, with the longitudinal opening forming the incomplete portion of the circular configuration. It should be noted that the foregoing ribs 36 provide the means whereby the sleeve 18 is shape-retaining and may be self-supporting above and about the holder 10.

If desired, a portion 38 of the material 34 may be perforated or have sewn thereinto an area defining at least one, preferably a plurality of air vents 37. The vented area 38 is generally just below the highest portion of sleeve 18 when in the use position over the holder 10. Alternatively, or in addition thereto, vents 37 may be disposed at or near the highest portion of the end 20 or ends 20, 22. If further desired, a fixed or movable flap 40 may be disposed above the vented area 38 to prevent water from entering the same.

In a second embodiment of the invention as is shown in FIGS. 3–4, the sleeve 18 is only in the form of a half circle, that is, unlike the three-fourths or larger incomplete circular cross section presented by the embodiment of FIG. 1. In all other respects, however, the basic structural configuration is substantially the same.

In the embodiment shown in FIG. 5, the structure is U-shaped and is closed at both ends 20, 22; end 22 not being openable, but rather, the entire sleeve 18 is removed as a housing in toto, from atop the holder 10. The substantially complete longitudinal opening is present which affords one the means for placing the same over the holder 10 and removable therefrom. If desired, means 40 may be provided along one side of the base portion 42 of the sleeve 18 to facilitate pivoting of the same away from the holder 10 without actually lifting the same off therefrom. Suitable handle means 44 may be disposed atop the sleeve 18 to facilitate either it's complete removal or the pivoting aforementioned. The venting area 38 may also be present if desired. Other attributes of the body of the sleeve 18 as described with reference to the preferred embodiment are present, if desired.

While the foregoing invention has been described with specific reference to the particular embodiments shown and described, it is not intended to be limited thereby.

I claim:

1. A flexible, self-supporting, shape-retaining protective device for use in conjunction with a log rack for storing logs, comprising a hollow walled partial sleeve capped at one distal end and open at the opposite distal end, movable capping means disposed at said opposite end, means for opening and closing said movable capping means, said capping means movable between and open and closed position about said open end, an apron depending from a lower portion of said capping means, a longitudinal opening running substantially entirely along the longitudinal axis of said sleeve between said two ends and engaging the periphery of said log rack, a plurality of rigid ribs diposed in spaced apart relation substantially about the entire longitudinal axis of said sleeve.

2. The device as defined in claim 1 wherein said sleeve defines a plurality of pockets for receiving said ribs.

3. The device as defined in claim 1 wherein said ribs are fixedly secured to the surface of said sleeve.

4. The device as defined in claim 1 wherein said apron includes at least one lateral wing, means on said wing for securing said wing to a fixed object.

5. The device as defined in claim 1 wherein said sleeve defines a cross section having a greater than half circular configuration.

6. The device as defined in claim 1 wherein at least a portion of said sleeve defines a plurality of air vents communicating therebetween.

7. The device as defined in claim 1 having a half circle cross section.

* * * * *